US007121846B2

(12) United States Patent
Katayanagi

(10) Patent No.: US 7,121,846 B2
(45) Date of Patent: Oct. 17, 2006

(54) CARD-LIKE ELECTRONIC DEVICE WHICH CAN READILY BE DISASSEMBLED

(75) Inventor: Masayuki Katayanagi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/105,297

(22) Filed: Apr. 13, 2005

(65) Prior Publication Data

US 2005/0233604 A1 Oct. 20, 2005

(30) Foreign Application Priority Data

Apr. 14, 2004 (JP) ..... 2004-119542

(51) Int. Cl.
*H01R 12/00* (2006.01)

(52) U.S. Cl. ..... 439/76.1

(58) Field of Classification Search ..... 439/76.1, 439/946; 361/737, 732

See application file for complete search history.

(56) References Cited

U.S. PATENT DOCUMENTS 5,529,503 A 6/1996 Kerklaan
5,923,026 A * 7/1999 Onoda ..... 235/492
6,457,982 B1 * 10/2002 Ko et al. ..... 439/95
6,527,188 B1 * 3/2003 Shobara et al. ..... 235/486
6,632,097 B1 * 10/2003 Chang ..... 439/76.1

FOREIGN PATENT DOCUMENTS

| | | |
|---|---|---|
| JP | 63-16698 | 1/1988 |
| JP | 6320890 | 11/1994 |
| JP | 8241388 | 9/1996 |
| JP | 2000322546 | 11/2000 |
| JP | 2001-518652 | 10/2001 |

* cited by examiner

*Primary Examiner*—Phuong Dinh
(74) *Attorney, Agent, or Firm*—Collard & Roe, P.C.

(57) ABSTRACT

In a card-like electronic device, a circuit board is interposed between a first cover and a second cover which is faced to the first cover and separable from the first cover towards a first direction. A connector is connected to the circuit board. The first cover has an engaging member including a movable latch and a spring portion urging the latch towards a second direction perpendicular to the first direction. The second cover has an engaged member including a latch receiving portion for receiving the latch. The latch is urged by the spring portion to a position where movement of the latch receiving portion in the first direction is locked.

10 Claims, 10 Drawing Sheets

CARD-LIKE ELECTRONIC DEVICE WHICH CAN READILY BE DISASSEMBLED

This application claims priority to prior Japanese patent application JP 2004-119542, the disclosure of which is incorporated herein by reference.

BACKGROUND OF THE INVENTION

This invention relates to a card-like electronic device such as an electronic card.

An electronic card generally comprises an intermediate frame such as a resin frame and a pair of covers such as metal covers attached to upper and lower surfaces of the intermediate frame. The electronic card is assembled by various known methods, for example, by adhering the metal covers to the upper and the lower surfaces of the intermediate frame by the use of a thermoplastic adhesive tape or a normal-temperature adhesion tape, by welding the metal covers on the upper and the lower surfaces, or by bonding the metal covers to the resin frame by ultrasonic welding. Further, there is also known a mechanical assembling method, for example, using a latch. In any event, no consideration has been made about disassembling of the electronic card after it is assembled.

At first, as a first conventional technique, description will be made of a method of assembling an IC card using an adhesive tape (for example, see Japanese Unexamined Patent Application Publication (JP-A) No. H06-320890). In this method, the IC card is assembled by sandwiching the adhesive tape between a frame and a cover. In this method, the adhesive tape must preliminarily be adhered to the frame or the cover. Therefore, an adhering operation is troublesome and an assembling cost and a material cost can not be suppressed. In case where a heat adhesive tape is used, a high-temperature pressure device is required in order to melt an adhesive. Further, a pressure cooling step is required in order to maintain an adhering effect. Accordingly, an expensive assembling apparatus and an increased working time are inevitably required. After completion of assembling of the IC card, an electrical problem or a mechanical damage in an exterior component such as a cover may sometimes occur. In this event, the IC card can not easily be disassembled because each component is firmly adhered by the adhesive. Even if the IC card can be disassembled, a mounting board or a connector as an internal component may possibly be damaged.

Next, as a second conventional technique, description will be made of a method of assembling a jacketed circuit card by welding (for example, see U.S. Pat. No. 5,529,503). In this method, upper and lower metal covers are attached to a frame by laser welding. This method requires an expensive laser welding apparatus. Further, it is generally impossible to disassemble the card.

As a third conventional technique, description will be made of a method of assembling a personal computer memory card by ultrasonic welding (for example, see Japanese Unexamined Patent Application Publication (JP-A) No. H8-241388). In this method, a first subassembly is produced by putting a first cover member into a first die and injection-molding a first frame member on the first cover member. Similarly, a second subassembly is produced by putting a second cover member into a second die and injection-molding a second frame member on a second die. Specifically, insert-molding is performed in a manner such that hooks of the first and the second cover members are embedded into legs of the first and the second frame members during injection-molding, respectively. The first and the second subassemblies are fixed to each other by ultrasonic welding. Then, the card is completed.

According to the third conventional technique, a resin molding apparatus is increased in scale. Since the above-mentioned molding operation is difficult, dimension control is troublesome. In addition, an expensive ultrasonic welding apparatus is required. Further, it is known that, when the first and the second cover members are applied with ultrasonic waves, electronic components mounted on an internal substrate may be adversely affected. Generally, it is impossible to disassemble the card after it is assembled.

As a fourth conventional technique, description will be made of a method of mechanically assembling a PC card (for example, see Japanese Unexamined Patent Application Publication (JP-A) No. 2000-322546). In this method, a top cover is provided with elastically deformable engaging protrusions formed on folding portions at opposite sides thereof. On the other hand, a bottom cover is provided with engaging grooves formed on folding portions at opposite sides thereof. By engaging the engaging protrusions with the engaging grooves, the top cover is attached to the bottom cover.

However, no consideration is made about disassembling of the PC card after it is assembled.

SUMMARY OF THE INVENTION

It is therefore an object of this invention to provide a card-like electronic device which can readily be disassembled.

It is another object of this invention to provide the card-like electronic apparatus of the type described, in which a disassembling operation can easily be carried out.

It is still another object of this invention to provide the card-like electronic apparatus of the type described, which can readily be assembled.

Other objects of the present invention will become clear as the description proceeds.

According to an aspect of the present invention, there is provided a card-like electronic device which comprises a first cover, a second cover faced to the first cover and separable from the first cover towards a first direction, a circuit board interposed between the first and the second covers, and a connector connected to the circuit board, the first cover having an engaging member including a movable latch and a spring portion urging the latch towards a second direction perpendicular to the first direction, the second cover having an engaged member including a latch receiving portion for receiving the latch, the latch being urged by the spring portion to a position where movement of the latch receiving portion in the first direction is locked.

According to another aspect of the present invention, there is provided a card-like electronic device comprising an electronic component, a circuit board to which the electronic component is mounted, a connector mounted to the circuit board, and a pair of covers, one of the covers having an engaging member, the other cover having an engaged member, the engaging member having a first locking portion elastically deformable and a pair of second locking portions of a blade-like shape and sandwiching the first locking portion, the engaged member having a locked portion engaged with the first locking portion and a pair of holding portions engaged with the second locking portions and sandwiching the second locking portions, the engaging member and the engaged member being engaged with each other to fix the covers to each other so that the electronic card is assembled.

DESCRIPTION OF THE PREFERRED EMBODIMENT

Figure 1:
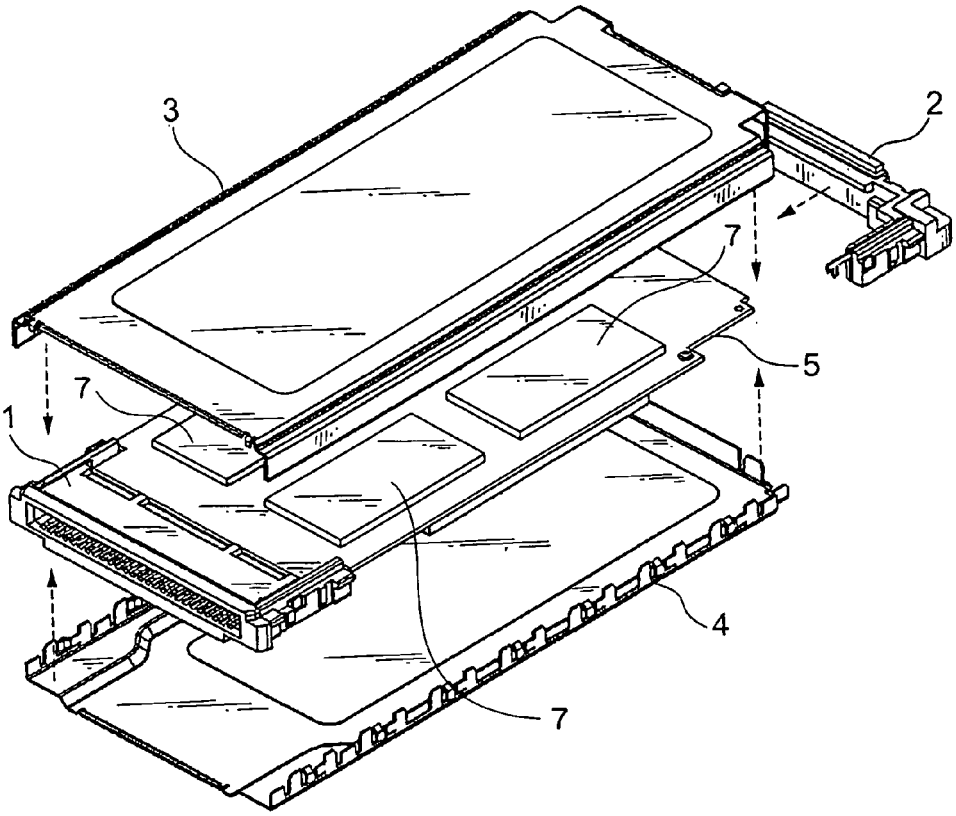
FIG. 1 is an exploded perspective view of a card-like electronic apparatus according to an embodiment of this invention.
Figure 2:
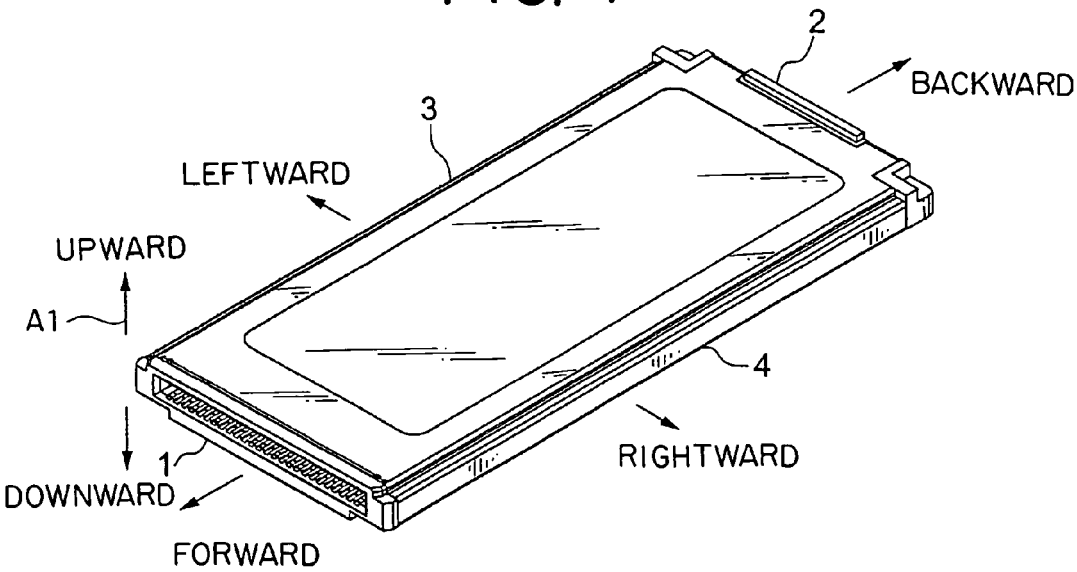
FIG. 2 is a perspective view of the card-like electronic apparatus when it is assembled.

Referring to FIGS. 1 and 2, description will be made of an entire structure of a card-like electronic device according to an embodiment of this invention.

The card-like electronic apparatus illustrated in the figures is generally called an electronic card. Therefore, the card-like electronic apparatus will hereinafter be called an electronic card. As shown in FIG. 1, the electronic card generally comprises five components. Specifically, the electronic card comprises a connector 1 for transmission and reception of electric signals between the electronic card and an electronic apparatus receiving the electronic card, a circuit board 5 to which the connector 1 and electronic components 7 for executing a function of the electronic card are mounted, an upper cover (second cover) 3 made of metal, a lower cover (first cover) 4 made of metal, and a back frame 2 covering a rear end of the electronic card and adapted to hold the circuit board 5 in the electronic card.

As shown in FIG. 2, the electronic card is assembled by clamping the connector 1 forming a forward end portion of the electronic card, the circuit board 5, and the back frame 2 forming the rear end of the electronic card by the upper and the lower covers 3 and 4. In this event, the upper and the lower covers 3 and 4 cooperate with each other to serve as a cover member covering the circuit board 5. As will later be described, the upper cover 3 is separable from the lower cover 4 in an upward direction, i.e., a first direction A1.

Referring to FIGS. 3 to 5, 6A, and 6B, the upper cover 3 will be described.

Figure 3:
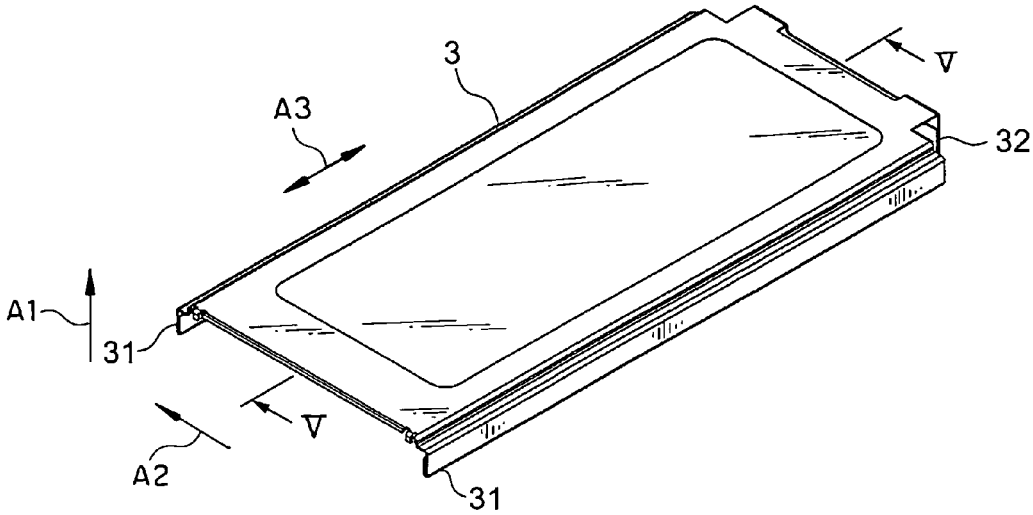
FIG. 3 is a perspective view of an upper cover of the card-like electronic apparatus.
Figure 4:
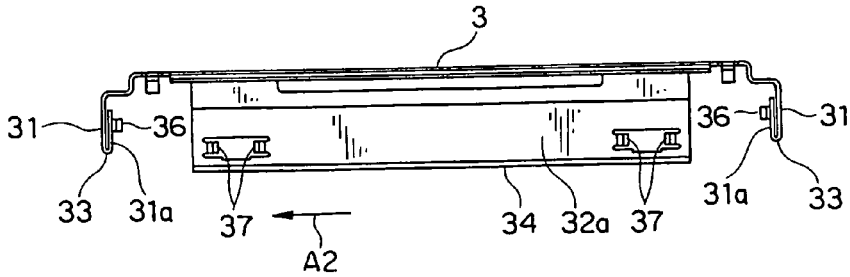
FIG. 4 is a front view of the upper cover.
Figure 5:
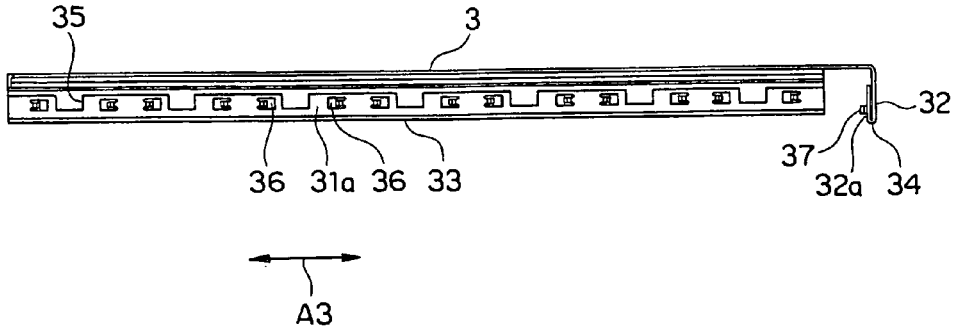
FIG. 5 is a sectional view taken along a line V—V in FIG. 3.
Figure 6A:
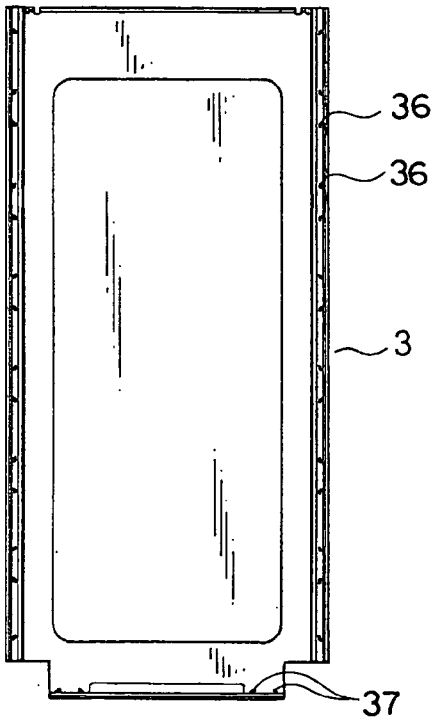
FIG. 6A is a bottom view of the upper cover.
Figure 6B:
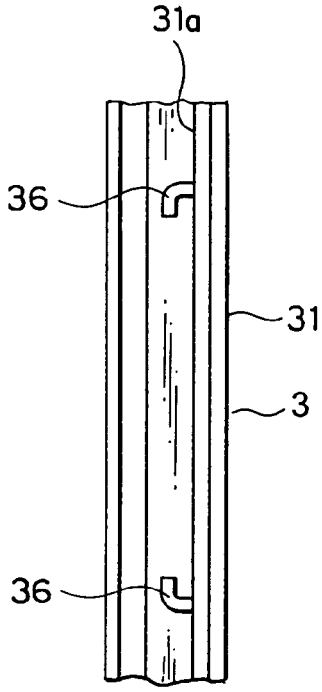
FIG. 6B is an enlarged view of a part of the upper cover in FIG. 6A.

As illustrated in FIG. 3, the upper cover 3 has opposite side portions 31 and a rear end portion 32 bent in a vertical direction. Further, as illustrated in FIGS. 4 and 5, the opposite side portions 31 and the rear end portion 32 are folded into U-section portions 33 and 34, respectively. By such folding, a sectional structure of each of the opposite side portions 31 and the rear end portion 32 has a strength about twice as large as that achieved by the thickness of the upper cover 3. Therefore, an intermediate frame such as a resin frame can be omitted. As a consequence, the circuit board 5 mounted inside the electronic card is increased in effective mounting area. Further, an edge portion of the upper cover 3 is folded inward of the upper cover 3 and, therefore, is not exposed on an outer surface of the electronic card. Accordingly, the edge portion may not be touched by fingers or the like during assembling of the electronic card and after completion of assembling. Thus, the above-mentioned structure assures safety for a user.

Figure 7:
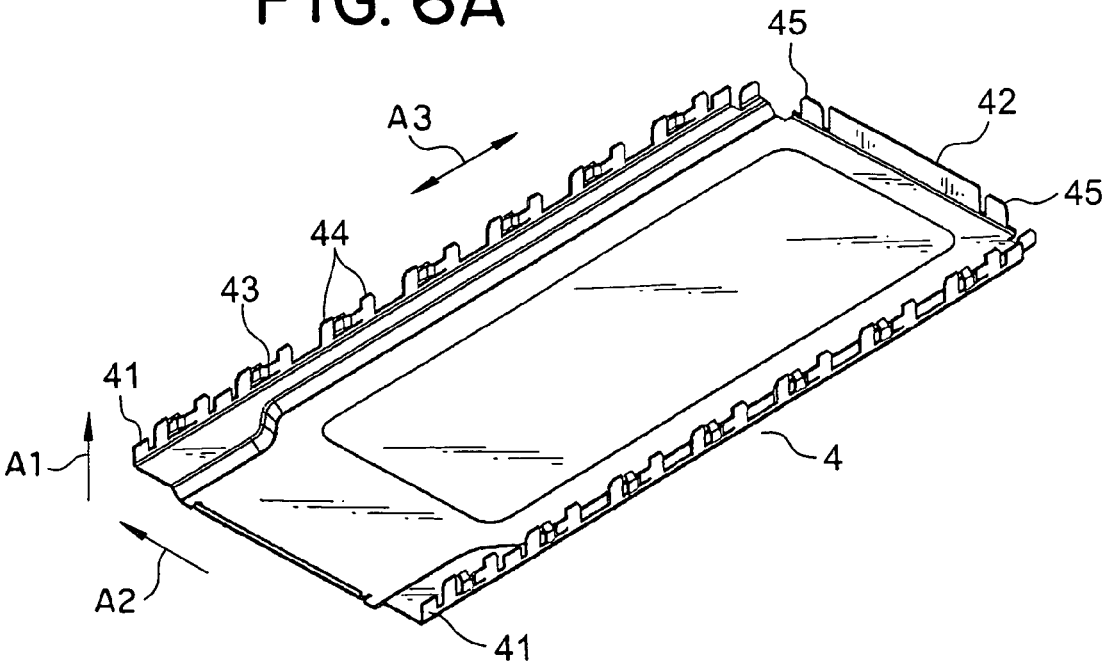
FIG. 7 is a perspective view of a lower cover of the card-like electronic apparatus.
Figure 8:
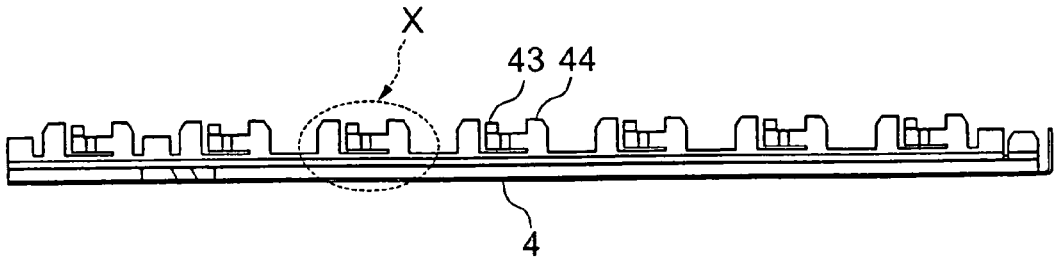
FIG. 8 is a right side view of the lower cover.
Figure 9B:
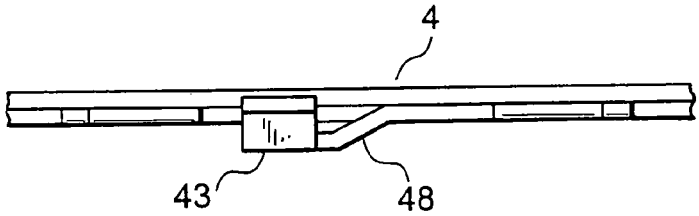
FIG. 9B is a plan view of FIG. 9A.
Figure 9C:
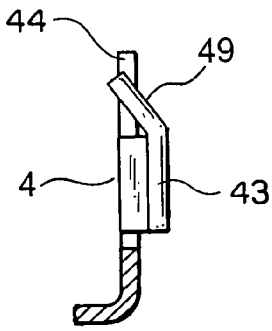
FIG. 9C is a partial sectional view taken along a line IXc—IXc in FIG. 9A.
Figure 9A:
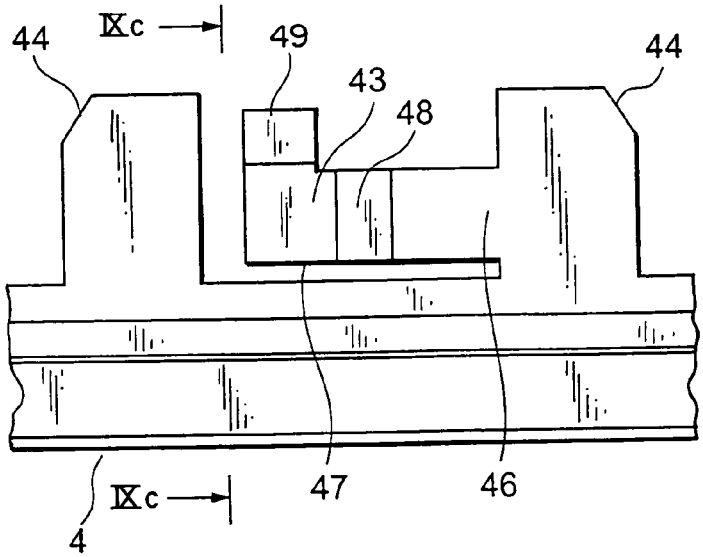
FIG. 9A is an enlarged front view of a portion X in FIG. 8.

Each of the opposite side portions 31 folded into the U-section portions 33 has an inner plate portion 31*a* provided with a plurality of spaces or recesses 35 to be engaged with a plurality of latches 43 formed on the lower cover 4 as shown in FIG. 7. It will readily be understood that the recesses 35 are equal in number to the latches 43. As will later be described, the latches 43 are movable in a second direction A2 perpendicular to the first direction A1 in FIG. 7.

Since the recesses 35 are formed inside the upper cover 3, an engaging portion of the upper cover 3 is not exposed on the outer surface of the electronic card so that an external appearance of the electronic card is not spoiled. Further, since the upper cover 3 and the lower cover 4 are engaged inside the electronic card, the user of the electronic card can not touch, either erroneously or intentionally, the engaging portion. Thus, the electronic card is prevented from being unnecessarily disassembled.

The inner plate portions 31*a* of the opposite side portions 31 are provided with a plurality of holding portions 36 bent into a crank shape to hold a plurality of blades 44 of the lower cover 4 shown in FIG. 7, respectively. The holding portions 36 are spaced from one another in a third direction A3 perpendicular to the first and the second directions A1 and A2. It will readily be understood that the holding portions 36 are equal in number to the blades 44.

Similarly, the rear end portion 32 has an inner plate portion 32*a* provided with a pair of holding portions 37 bent into a crank shape to hold a pair of blades 45 of the lower cover 4 shown in FIG. 7, respectively. The holding portions 37 are spaced from each other in the second direction A2.

Since the holding portions 36 and 37 are formed inside the upper cover 3, the engaging portion of the upper cover 3 is not exposed on the outer surface of the electronic card so that the external appearance of the electronic card is not spoiled. Further, since the upper cover 3 and the lower cover 4 are engaged inside the electronic card, the user of the electronic card can not touch, either erroneously or intentionally, the engaging portion. Thus, the electronic card is prevented from being unnecessarily disassembled.

Referring to FIGS. 7, 8, 9A, and 9B, the lower cover 4 will be described.

Figure 10A:
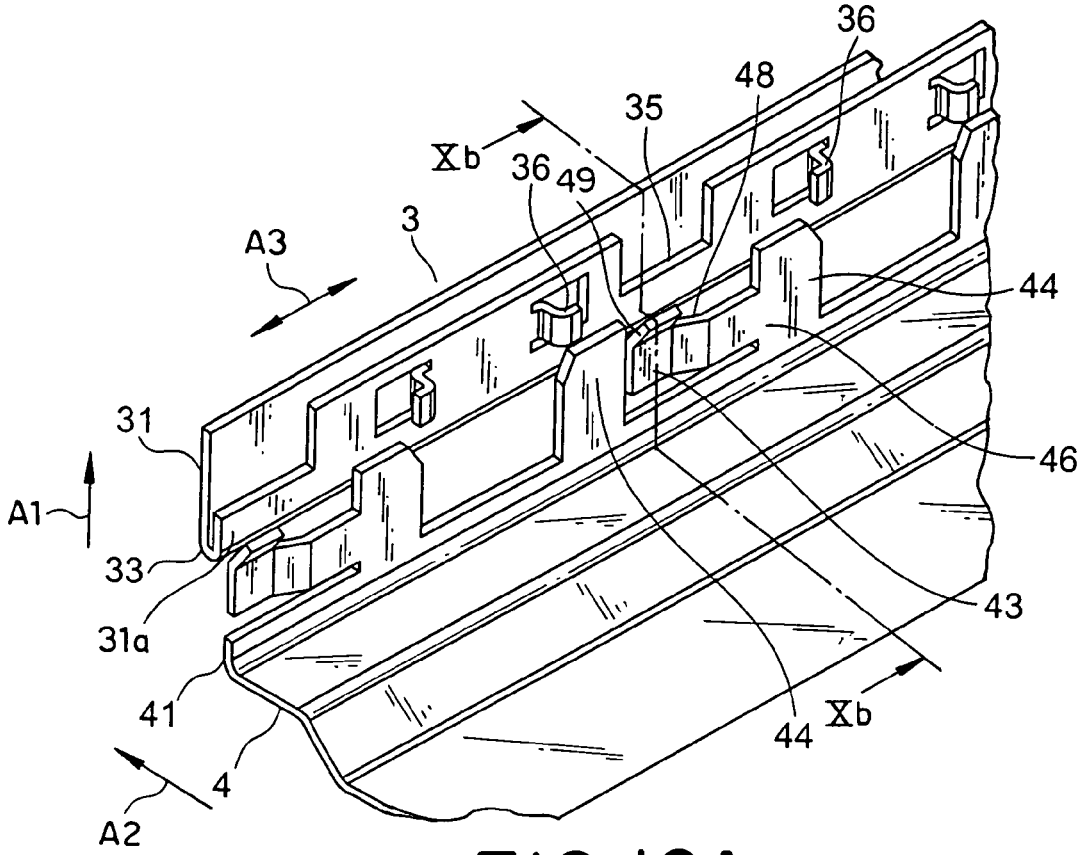
FIG. 10A is a partial perspective view of the upper and the lower covers immediately before engagement.
Figure 10B:
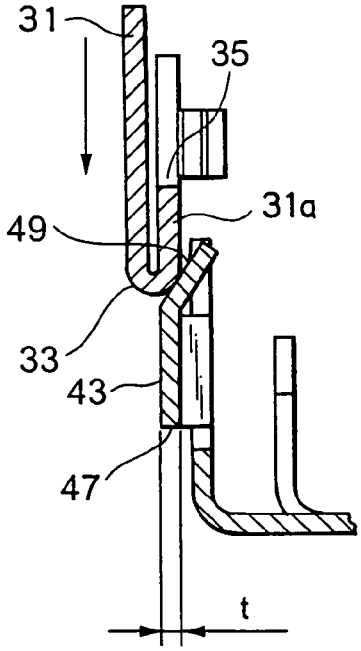
FIG. 10B is a sectional view taken along a line Xb—Xb in FIG. 10A.

As shown in FIG. 7, the lower cover 4 has opposite end portions 41 and a rear end portion 42. The opposite end portions 41 and the rear end portion 42 are bent in the vertical direction. The opposite end portions 41 are provided with the latches 43 and the blades 44 to be engaged with the recesses 35 and the holding portions 36 of the upper cover 3, respectively. The rear end portion 42 is provided with the blades 45 to be engaged with the holding portions 37 of the upper cover 3, respectively. The latches 43 are formed by punching the opposite side portions 41 of the lower cover 4. Each of the latches 43 is located between two adjacent ones of the blades 44 and is connected to one of the blades 44 via a spring portion 46. The lower cover 4 and the upper cover 3 are locked to each other by the use of a locking portion 47 (see FIGS. 10B and 11B), namely, a lower end of each latch 43 obtained by punching.

In order that the locking portion 47 is engaged with a part of an edge of each recess 35 of the upper cover 3, each of latches 43 is positioned outward from the opposite end portions 41. For obtaining this position of each of the latches 43, a slant portion 48 is integrally connected between the latch 43 and the spring portion 46. Further, the latch 43 is provided at its upper end with a slant portion 49 slanted inwardly, that is, towards a direction opposite to the second direction A2.

Referring to FIGS. 10A, 10B, 11A, and 11B, description will be made of the relationship between the upper cover 3 and the lower cover 4.

Each of the side portions 41 of the lower cover 4 is located inside each of the side portions 31 of the upper cover 3. The recess 35 of the upper cover 3 and the locking portion 47 of the lower cover 4 have a positional relationship such that they interfere with each other in a direction of a thickness t at the locking portion 47 of the lower cover 4 in FIG. 10B. When the upper cover 3 is moved relative to the lower cover 4 in a direction depicted by an arrow in FIG. 10B, the U-section portion 33 of the upper cover 3 presses the slant portion 49 of the lower cover 4 inward (rightward). At this time, the latch 43 is displaced inward by an amount corresponding to the thickness t and is kept displaced inward until the latch 43 is engaged with the edge of the recess 35 of the upper cover 3.

Figure 11A:
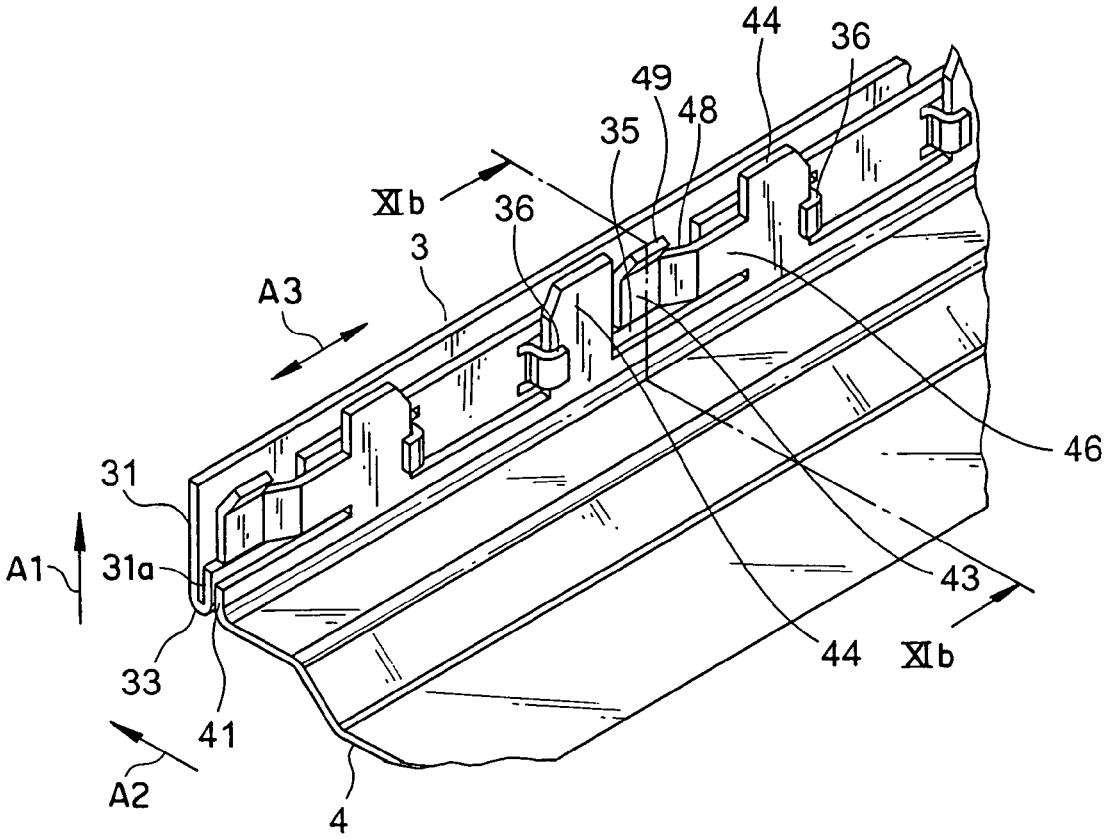
FIG. 11A is a partial perspective view of the upper and the lower covers after engagement.
Figure 11B:
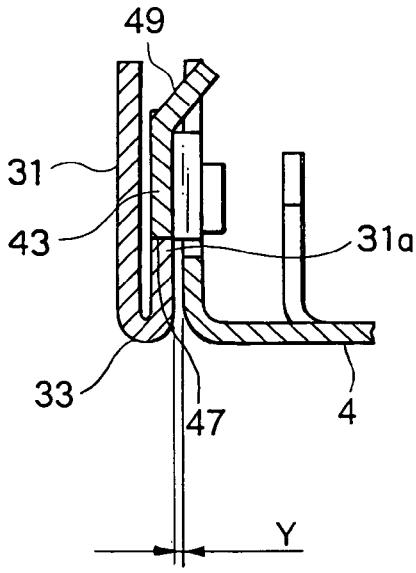
FIG. 11B is a sectional view taken along a line XIb—XIb in FIG. 11A.

As shown in FIGS. 11A and 11B, when closing of the upper cover 3 and the lower cover 4 is completed, the latch 43 enters into the recess 35 of the upper cover 3 under a restoring force of the spring portion 46. As a consequence, the locking portion 47 is engaged with the edge of the recess 35.

On the other hand, following the engagement between the exposed end face 47 and the edge of the recess 35, each blade 44 of the lower cover 4 is guided by a tapered corner thereof to be inserted into each holding portion 36 of the upper cover 3.

As a result of the engagement between each exposed end face 47 and each recess 35 and the engagement between each blade 44 and each holding portion 36, relative movement of the upper cover 3 and the lower cover 4 is completely locked in a back-and-forth direction, a leftward-and-rightward direction, and an up-and-down direction of the electronic card. Therefore, the covers 3 and 4 are not easily disassembled.

Assuming that the above-mentioned engaging structure for completely locking the relative movement of the covers 3 and 4 is a single unit, a plurality of units are uniformly arranged on opposite side portions of the electronic card. Then, it is possible to assure a sufficient mechanical strength against a twisting moment of the electronic card.

Figure 12:
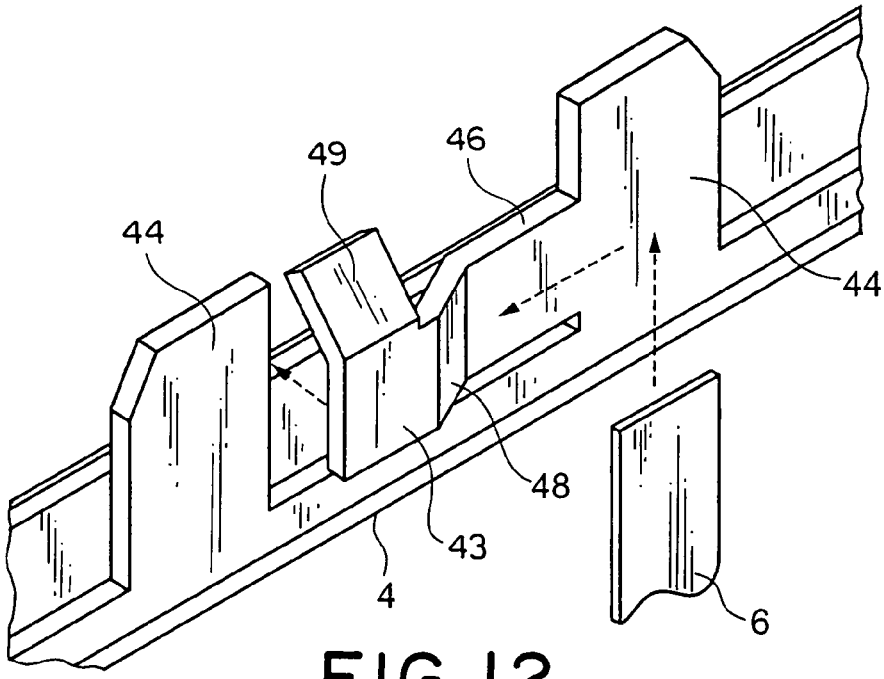
FIG. 12 is a perspective view showing a state where an unlocking tool is inserted into a latch portion of the lower cover.
Figure 13:
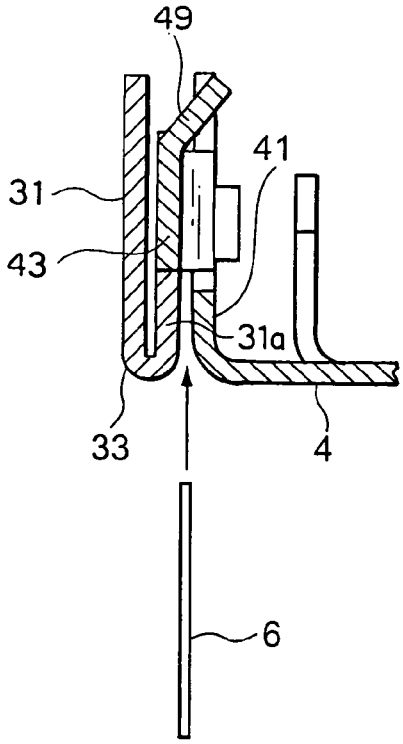
FIG. 13 is a schematic sectional view for describing an operation of unlocking the latch from a recess of the upper cover.

Referring to FIGS. 12 and 13, description will be made of an operation of unlocking the latch 43 of the lower cover 4 from the recess 35 of the upper cover 3.

In a closed state of the covers 3 and 4 illustrated in FIG. 11, an unlocking tool 6 of a thin-plate shape is inserted into a gap Y between the covers 3 and 4 and between the holding portions 36. Subsequently, the unlocking tool 6 is moved forward of the electronic card from a side adjacent to the spring portion 46 of the latch 43 to be brought into contact with the slant portion 48 of the latch 43. When the unlocking tool 6 is further moved forward of the electronic card, the slant portion 48 is pressed by the unlocking tool 6 so that the exposed end face 47 is forced to move along the slant portion 48 to be displaced inward of the electronic card. As a consequence, the covers 3 and 4 are unlocked and allowed to be disassembled. Thus, the covers 3 and 4 are disassembled by a simple operation mentioned above. The above-mentioned structure is useful in simplification of a disassembling facility and saving of work and time in a disassembling operation.

The above-mentioned unlocking operation is described in conjunction with one unit. However, unless all units formed on the covers 3 and 4 are unlocked, the electronic card can not be disassembled. In view of the above, use may be made of a structure such that all the units are simultaneously unlocked. For example, it is assumed that a plurality of engaging members (each comprising a single latch 43 and a pair of blades 44) and a plurality of engaged members (each comprising a single recess 35 and a pair of holding portions 36) are formed on opposite sides of the covers 3 and 4 at fourteen positions in total. In this case, if a plurality of unlocking tools 6, fourteen in number, are integrally formed, all the units can simultaneously be unlocked.

Referring to FIGS. 14 to 18, description will be made of assembling steps of the electronic card in sequence.

Figure 14:
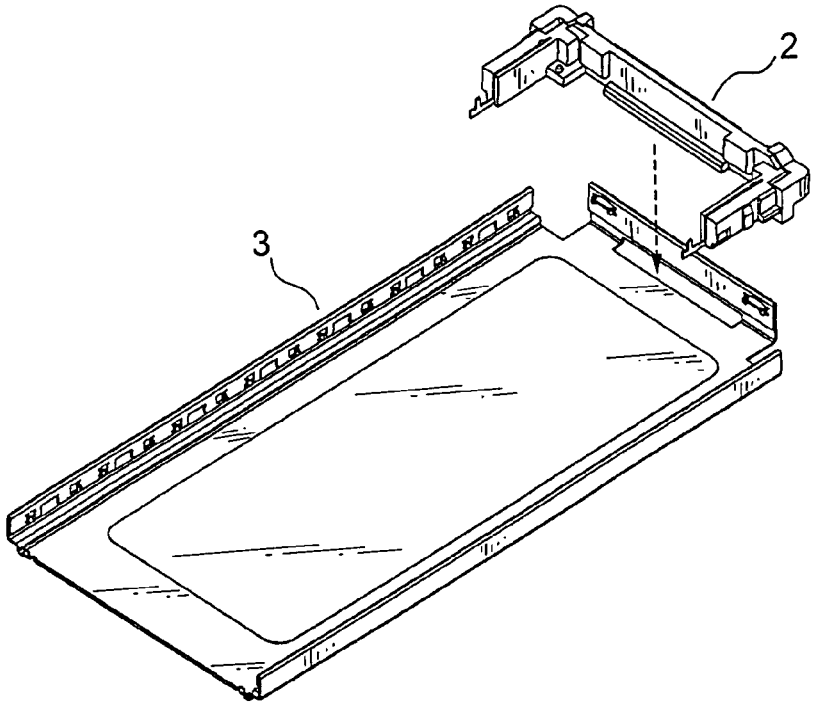
FIG. 14 is a perspective view for describing a first step of a method of assembling the card-like electronic device.

At first referring to FIG. 14, the back frame 2 for covering the rear end of the electronic card and holding the circuit board inside the electronic card is attached to the upper cover 3. These components can be manually assembled without requiring an assembling tool.

Figure 15:
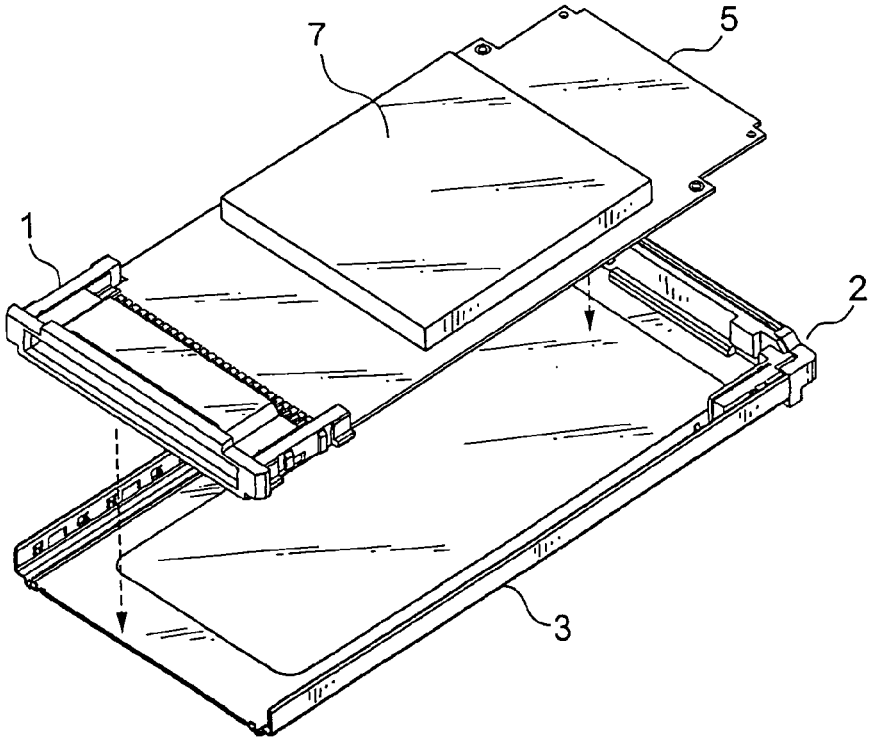
FIG. 15 is a perspective view for describing a second step of the method.
Figure 16:
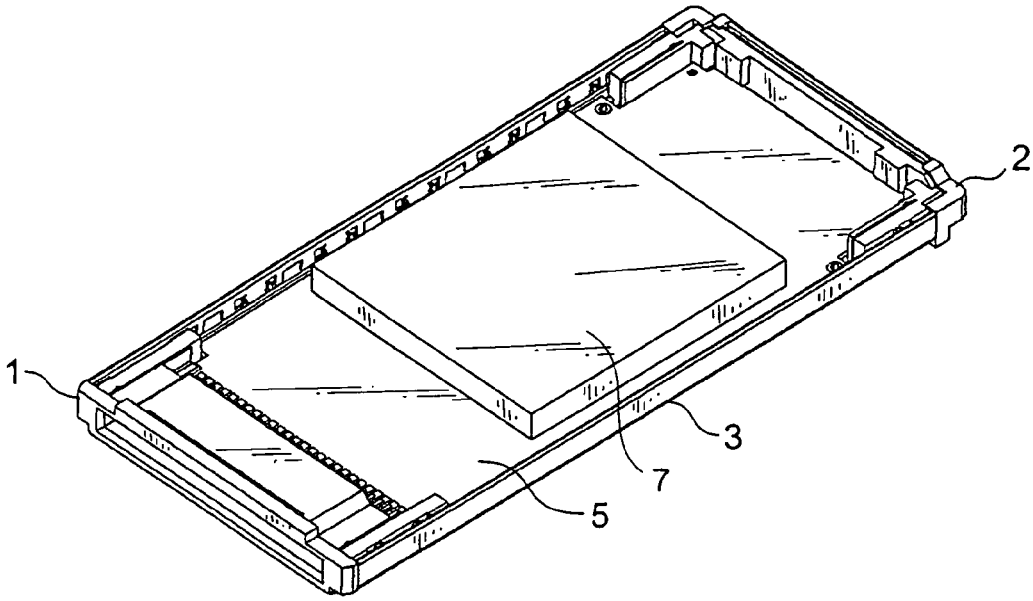
FIG. 16 is a perspective view for describing a third step of the method.

Next referring to FIG. 15, the connector 1 is mounted to the circuit board 5. The connector 1 and the circuit board 5 are attached to the upper cover 3. Then, the state illustrated in FIG. 16 is obtained. These components can be manually assembled without requiring an assembling tool.

Figure 17:
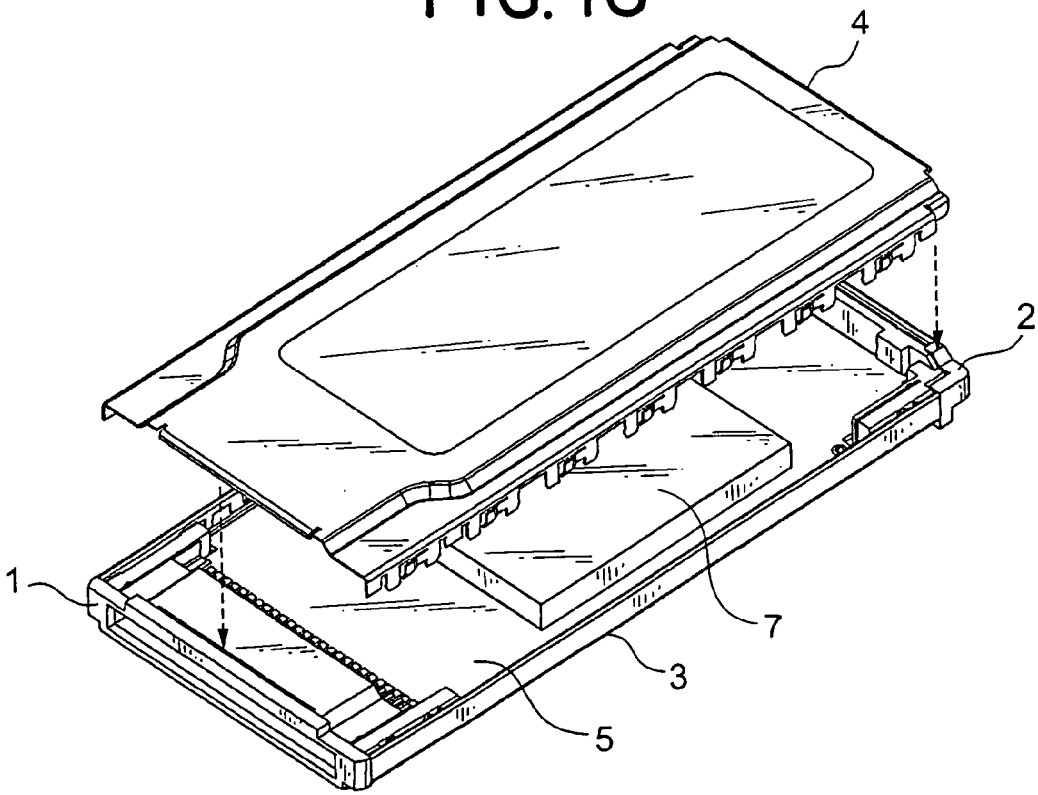
FIG. 17 is a perspective view for describing a fourth step of the method.

Referring to FIG. 17, the lower cover 4 is attached to the upper cover 3. Again, these components can be manually assembled without requiring an assembling tool.

Figure 18:
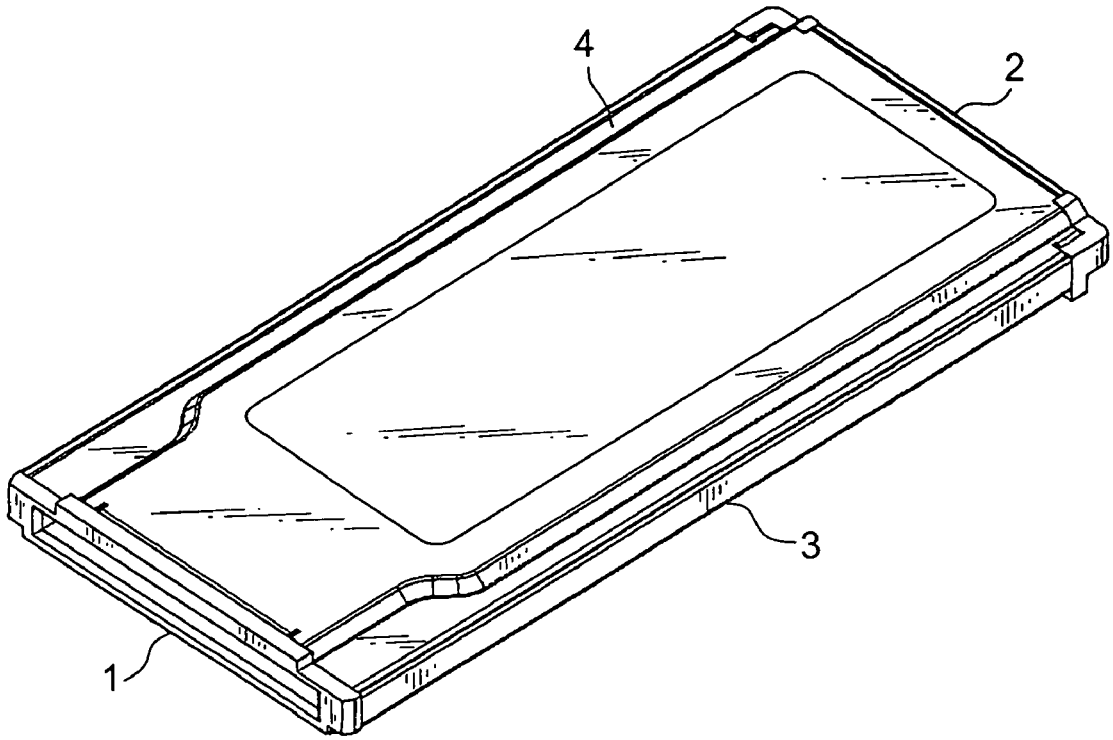
FIG. 18 is a perspective view showing a state where the card-like electronic device is assembled after completion of all steps of the method.

Then, as illustrated in FIG. 18, the electronic card is assembled and completed.

In the foregoing description, each of the upper and the lower covers 3 and 4 is made of metal. Alternatively, each cover may be molded by a conductive resin or may be molded by a resin and then coated with a metal film by plating or vapor deposition.

While the present invention has thus far been described in connection with a preferred embodiment thereof, it will readily be possible for those skilled in the art to put this invention into practice in various other manners. For example, although the lower cover is provided at each side portion with a number of latches in the drawing, only one latch may be provided at each side portion of the lower cover. The card-like electronic apparatus may be embodied as an IC card well known in the art.

What is claimed is:

1. A card-like electronic device comprising:

a first cover;

a second cover faced to the first cover and separable from the first cover towards a first direction;

a circuit board interposed between the first and the second covers; and a connector connected to the circuit board, the first cover having an engaging member including a movable latch and a spring portion urging the latch towards a second direction perpendicular to the first direction, the second cover having an engaged member including a latch receiving portion for receiving the latch, the first and the second covers forming a cover member, the engaging member and the engaged member being disposed inside the cover member, the latch being urged by the spring portion to a position where movement of the latch receiving portion in the first direction is locked, the second cover having a elate portion folded inward of the cover member, the latch receiving portion being formed on the plate portion, and the engaged member further having a pair of holding portions formed on the plate portion and spaced from each other in a third direction perpendicular to the first and the second directions, the engaging member further having a pair of blades faced to the elate portion, extending in the first direction, and spaced from each other, the blades being locked by the holding portions in a direction opposite to the second direction.

2. The card-like electronic device according to claim 1, wherein the plate portion has an edge defining a space between the holding portions, a part of the edge serving as the latch receiving portion.

3. The card-like electronic device according to claim 1, wherein the latch is located between the blades and connected to one of the blades via the spring portion.

4. The card-like electronic device according to claim 3, wherein the latch has a slant portion formed at its end in the first direction and extending in a direction inclined with respect to the first and the second directions.

5. The A card-like electronic device comprising:

a first cover;

a second cover faced to the first cover and separable from the first cover towards a first direction;

a circuit board interposed between the first and the second covers; and a connector connected to the circuit board, the first cover having an engaging member including a movable latch and a spring portion urging the latch towards a second direction perpendicular to the first direction, the second cover having an engaged member including a latch receiving portion for receiving the latch, the first and the second covers forming a cover member, the engaging member and the engaged member being disposed inside the cover member, the latch being urged by the spring portion to a position where movement of the latch receiving portion in the first direction is locked, and a gap left between the first and the second covers to allow insertion of a tool for moving the latch in a direction opposite to the second direction.

6. The card-like electronic device according to claim 5, wherein the engaging member further has a slant portion formed between the latch and the spring portion and faced to the gap.

7. The card-like electronic device according to claim 1, further comprising an electronic component mounted to the circuit board.

8. A card-like electronic device comprising:

an electronic component;

a circuit board to which the electronic component is mounted;

a connector mounted to the circuit board; and a pair of covers, one of the covers having an engaging member, the other cover having an engaged member, the engaging member having a first locking portion elastically deformable and a pair of second locking portions of a blade-like shape and sandwiching the first locking portion, the engaged member having a locked portion engaged with the first locking portion and a pair of holding portions engaged with the second locking portions and sandwiching the second locking portions, the engaging member and the engaged member being engaged with each other to fix the covers to each other so that the electronic card is assembled.

9. The card-like electronic device according to claim 8, wherein the first locking portion is provided with a slant portion, the electronic card being disassembled by pressing the slant portion after an unlocking tool is inserted into a gap between the covers and between the holding portions.

10. The card-like electronic device according to claim 5, further comprising an electronic component mounted to the circuit board.

* * * * *